United States Patent [19]

Perrier et al.

[11] Patent Number: 4,674,917

[45] Date of Patent: Jun. 23, 1987

[54] METHOD AND DEVICE FOR PLACING A CONSTRUCTION MATERIAL IN A LIQUID ENVIRONMENT

[75] Inventors: Hubert Perrier; Didier Faucon, both of Grand Quevilly, France

[73] Assignee: Laboratoire Central des Ponts et Chaussees, Paris, France

[21] Appl. No.: 758,280

[22] Filed: Jul. 24, 1985

[30] Foreign Application Priority Data

Jul. 24, 1984 [FR] France ..... 84 11700
Jul. 24, 1984 [FR] France ..... 84 11701

[51] Int. Cl.[4] ..... B63C 11/00; E02D 29/06

[52] U.S. Cl. ..... 405/223; 405/190; 405/195

[58] Field of Search ..... 405/15–17, 405/19, 32, 172, 195, 222, 223, 229, 239, 258, 8–10, 185, 188, 190–193; 75/0.5 C; 264/35, 256, 333; 428/36, 293, 703

[56] References Cited

U.S. PATENT DOCUMENTS

| | | | |
|---|---|---|---|
| 2,731,066 | 1/1956 | Hogendobler et al. | 428/293 |
| 2,789,399 | 4/1957 | Finn | 405/258 X |
| 2,842,897 | 7/1958 | Finn | 405/258 X |
| 3,314,239 | 4/1967 | Baron et al. | 405/223 |
| 3,684,645 | 8/1972 | Temple et al. | 428/293 X |
| 3,977,057 | 8/1976 | Fernandez . | |

FOREIGN PATENT DOCUMENTS

| | | | |
|---|---|---|---|
| 538342 | 8/1984 | Australia . | |
| 0017548 | 10/1980 | European Pat. Off. . | |
| 1414428 | 11/1964 | France . | |
| 2075678 | 10/1971 | France . | |
| 51688 | 4/1980 | Japan | 405/15 |
| 2004817 | 4/1979 | United Kingdom . | |
| 1074971 | 2/1984 | U.S.S.R. | 405/15 |

*Primary Examiner*—Cornelius J. Husar
*Assistant Examiner*—Nancy J. Stodola
*Attorney, Agent, or Firm*—Brumbaugh, Graves, Donohue & Raymond

[57] ABSTRACT

A continuous linear element is used in the form of a fine fibrous trap, delivered in a continuous manner by an ejector (11) placed in a gaseous atmosphere established in an open-bottomed bell (8) immersed in the liquid medium with its open bottom close to the deposition site of the construction material. A slurry of solid particles is injected into the fibrous trap when it is still in the gaseous atmosphere of the bell and the trap charged with said particles is then deposited on the construction site (1). The ejector (11) can be part of a device (12) for breaking up textile cable (17) and is connected with a floating platform (3).

12 Claims, 2 Drawing Figures

METHOD AND DEVICE FOR PLACING A CONSTRUCTION MATERIAL IN A LIQUID ENVIRONMENT

Figure 1:
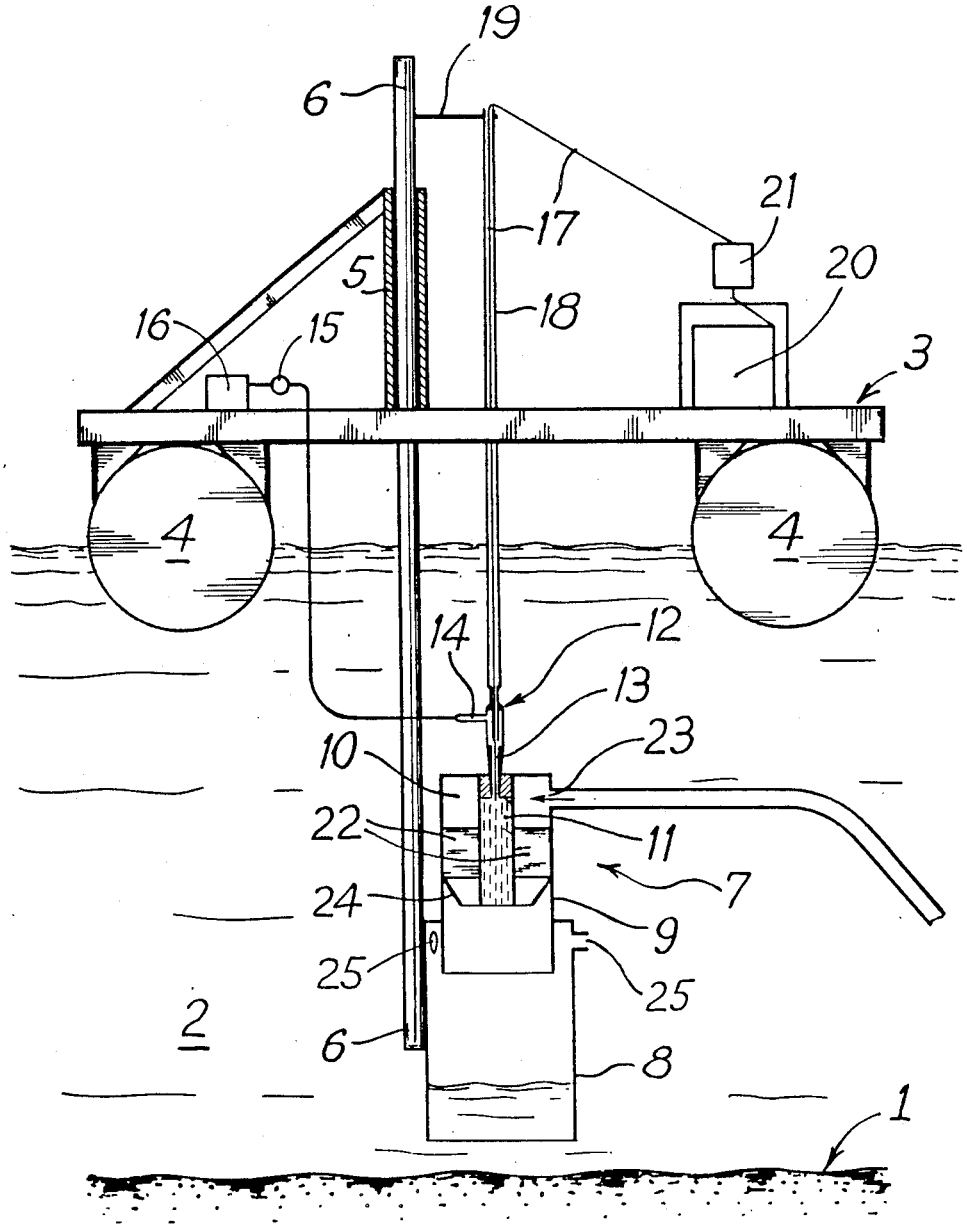

This invention concerns the placement in a liquid medium of a construction material consisting of a mass of solid particles of compact form reinforced by at least one continuous linear element.

A material of the above type is described in Applicant's document No. EP-B-0017548. Said document describes a material and means for placement thereof that are particularly designed for land applications, such as embankments or similar earthworks.

The present invention is directed to providing a method of placement that is specifically intended for applications in a liquid medium, especially in a marine environment.

In accordance with the invention, a continuous linear element in the form of a fine fibrous trap is used. The fibrous trap is formed by delivery of substantially parallel fibers in a continuous manner by an ejector placed in a gaseous atmosphere established in an open-bottomed, diving bell-like member which is immersed in the liquid medium such that the open bottom thereof is at a short distance from the site where the construction material is deposited. A liquid suspension of solid particles is injected into said fine fibrous trap when it is still in said gaseous atmosphere and the fine fibrous trap charged with said particles is deposited on the deposition site.

The suspension is advantageously composed of dredging sands, slurries and the like which can be gathered on location. The fibrous trap serves to confine the materials contained in the suspension and to prevent their dispersion.

Fabricating the fiber-trapped material in a gaseous atmosphere enables the particles to be confined without creating disturbing turbulences which might drive out the suspended materials and destroy the fibrous trap.

It is particularly advantageous that the fine fibrous trap be made of a broken up textile cable or cord.

Accordingly, a textile cord, ie. an assembly or wad of a large number of filaments or, otherwise stated, of so-called continuous, very long textile fibers, neither substantially twisted nor crossed, is used to form the fibrous trap. The cord or cable is broken up to loosen the elements thereof and thereby obtain individual filaments that are substantially parallel and continuous. It is much more convenient to use a textile "cable" than a plurality of bobbins in the formation of the fibrous trap. The most common packaged form available, known as "câble bambané" in France, consists of yarn stacked in loose figure-eight loops in a container.

The cable is entrained through a guiding conduit with a compressed gas and the gas is suddenly expanded by an abrupt increase in the cross section of the guiding conduit.

An axial return stream of the gaseous entraining fluid is used to break up the cable into loosened filaments.

The invention also provides a device for implementing the method just described. Said device comprises: an open-bottomed bell adapted to contain compressed gas, said open bottom being kept a short distance from the deposition site of the construction material; at least one ejector, having an ejection orifice that issues into the bell's gaseous atmosphere and which is designed to eject a continuous linear element in the form of a fine fibrous trap; and at least one injection means surrounding the ejection orifice of the ejector, designed to inject a suspension of solid particles in liquid into said fine fibrous trap.

Advantageously, the ejector is provided as part of a device for breaking up or bursting textile cable, comprising a guiding conduit for the cable. The guiding conduit comprises a feed section and a bursting section. The feed section including means for injecting a compressed gas, arranged such as to entrain the cable in the guiding conduit. The breakup section is located downstream from the feed section and has, relative thereto, an abruptly increased cross section.

Advantageously, the device is linked to a pontoon or floating platform.

Advantageously, the breakup device is connected to a store of textile cable on the pontoon and a protective sheath is provided for the textile cable.

Advantageously, the injection means is connected to a seabed pumping facility.

Advantageously, the injection means comprises an annular chamber surrounding the ejector and provided with diametrical fins.

Advantageously, a deflector or baffle is provided to direct the injected suspension to the fine fibrous trap.

Advantageously, the bell includes discharge apertures for controlled discharge of the compressed gas therein.

The invention is particularly applicable to the construction of sea floor embankments and man-made islands: it can produce very steep sloped banks which considerably reduce the total volume of material to be placed.

Figure 2:
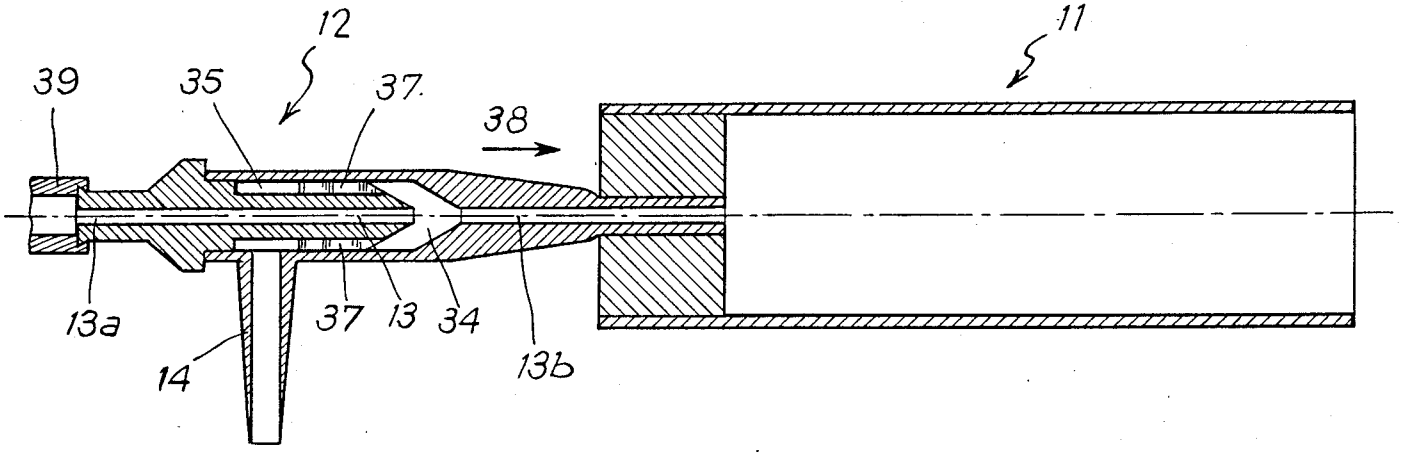

The invention will be more readily understood in reading the description hereinafter of a preferred embodiment, taken in conjunction with the appended drawings in which:

FIG. 1 schematically illustrates an installation for placement of the construction material on a water-covered surface, the different components of the installation being obviously drawn out of scale for clearer graphical representation; and FIG. 2 is a longitudinal cross section of a textile cable breakup or "bursting" device.

As can be seen, a pontoon 3 floats on conventional flotation means 4 in a body of water 2 over a bottom 1. The pontoon comprises a vertical sleeve 5 which is solidly attached and adapted to have a pole 6 slide therein, said pole sinking into the water and supporting the placement device 7 proper. Means omitted from the drawing are used to change and adjust the sinking of pole 6 to keep the device 7 at the right height in relation to bottom 1.

The device 7 comprises a cylindrical bell 8, open at the bottom. A cylindrical element 9, also open at the bottom, issues into and projects from the top of the bell.

Cylindrical element 9 has an annular chamber 10 surrounding the bursting chamber 11 of the textile cable bursting device 12, or ejector. Said ejector 12 has a center conduit 13 for feeding in the textile cable 17. Conduit 13 includes an upstream section **13*a*, located before its gas injection point, and downstream section 13*b***, located after the injection point.

Gas is injected through a truncated conical member 34 fed from an annular chamber 35 into which issues a pipe connection 14 connected via a pressure gauge 15 to a source of compressed gas, for instance to air compressor 16 providing air at 7 bar of pressure. Radial fins 37 arranged longitudinally in annular chamber 35 prevent the gas swirling and give it a stable, longitudinal direction.

The gas thus enters the center channel 13 at an oblique angle. The bulk of the injected gas serves to entrain the cable present in the center channel 13 in the direction of the arrow 38, both by direct friction and by a vacuum effect. To accommodate the gas flow, the downstream cross section 13*b* of the channel is slightly larger than the upstream cross section 13*a*. For example, the respective diameters of the two sections may be 5 and 4 mm for a cable with a diameter of 2 to 3 millimeters.

The entrained cable goes through the channel's downstream section 13*b* and issues into bursting chamber 11 which is characterized by a very abrupt increase in cross section (70 mm in diameter in the numerical example just given). At this point, the compressed gas mixed with the entrained cable suddenly expands, causing the cable to burst into a fluffed mass of (still continuous) filaments filling the space of chamber 11.

Given the output D (in $m^3/s$) of the compressor feeding the annular chamber 5, it has been calculated that the various components should comply with the following size criteria, where S and s stand for the respective cross sections of chamber 11 and section 13 and d is the cross section of the cable:

$$S \leqq D/25$$

$$2d < S \leqq D/550$$

$$22 < S/s < D/50d$$

Chamber 11 can have a circular, an elliptical, a rectangular or other cross section.

It has been necessary to prepare the cable 17 by slightly moistening it to give it the required cohesiveness. Drying and prebursting of the cable are carried out in the upstream section 13*a* of the ejector, thanks to an axial return flow occurring automatically at injection member 34.

The textile cable 17 is fed to the inlet of the device 12 under the protection of a sealed sheath 18, connected by a support arm 19 to pole 6 in order to move with it. Cable 17 comes from a store 20 of container-packed cable via a cable feed control system 21. Store 20 is disposed on the floating platform and sheltered from the water 2.

Annular chamber 10 surrounding the bursting chamber 11 has diametrical fins 22 designed to transform the more or less swirling flow of the suspension injected therein via an inlet 23 connected to a pump (not shown) into a longitudinal flow. A conical deflector 24 constricts the bottom outlet of the annular chamber 10 along the outlet from bursting chamber 11.

Adjustable air outlets 25 are provided in the top of the bell 8, at the level of the cylindrical member surrounding the outlet of element 9 so as to limit the overpressure in the bell.

Operation of the device is as follows:

Device 7 is set at a level to bring the bottom of bell 8 within a few centimeters of the bottom or seabed 1 to be built up.

The compressed air from compressor 16 serves on the one hand to pull along and burst cable 17 in bursting device 12 and on the other hand to supply the bell 8 with compressed air. Bell 8 is thus filled with air, except in its bottom part where water has risen a small amount therein (about 20 centimeters).

Connection 23 is supplied with the suspension of solid particles which may consist of dredging sand in suspension, pumped directly from the seabed or bottom 1.

This suspension or slurry is directed by deflectors 24 into the bursted or expanded cable leaving chamber 11. It is crucial to adjust the longitudinal flow rate of the slurry at this point to a value less than the output rate of expanded cable to avoid having the slurry draw along the cable as this would squeeze the individual filaments back together and reduce the burst cable's trapping capability.

The burst cable, charged with slurry, or at least with the particles of the slurry, goes through bell 8 and crosses the small layer of water thereunder and piles up on the bottom.

As deposition progresses, device 7 is moved vertically and/or laterally to continue placement.

Alternatively, the bell can be given self-supporting means; the cable bursting device can be replaced by another device providing a fibrous trap, for example based upon a set of spools or bobbins of individual filaments, albeit this would be less practical; and a plurality of ejectors of fine fibrous traps, each surrounded by its own slurry injection device, can be provided in a single bell.

We claim:

1. A method for placing a construction material in a liquid medium said material consisting of a compact mass of solid particles reinforced by at least one continuous linear fibrous element comprising (a) immersing an open-bottomed bell having a gaseous interior environment into the liquid medium in which said construction material is to be placed;

(b) positioning said bell proximally to a construction site selected to receive said construction material;

(c) expanding said linear fibrous element to form a linear fibrous trap and delivering said trap into the gaseous environment within the bell;

(d) injecting said solid particles into the linear fibrous trap within the gaseous environment so that the solid particles become entrained within the trap; and (e) depositing said fibrous trap and entrained solid particles at the selected construction site.

2. A method according to claim 1, wherein the solid particles are injected in the form of a slurry.

3. A method according to claim 1, wherein the linear fibrous trap is formed from a plurality of substantially parallel filaments.

4. A method according to claim 3, wherein individual filaments of a textile cable are loosened to provide the substantially parallel filaments.

5. Apparatus for depositing a construction material in a liquid medium said material consisting of a compact mass of particles reinforced by at least one continuous linear fibrous element comprising (a) an open-bottomed bell adapted to contain a compressed gas so that when the bell is immersed in the liquid medium a gaseous environment can be maintained within the interior of the bell;

(b) at least one ejector means having a conduit therethrough said conduit communicating with the interior of the bell, said ejector means being arranged to deliver a linear fibrous element via the conduit and said conduit being sized such that the linear element is expanded to form a linear fibrous trap upon leaving the conduit; and (c) at least one injection means capable of injecting solid particles into the interior of the bell such that the solid particles become entrained within the linear fibrous trap.

6. An apparatus according to claim 5 further comprising a bursting chamber communicating with the conduit of said ejector and having a larger diameter than said conduit such that the linear element entering the burst chamber from the conduit expands to form the linear fibrous trap.

7. An apparatus according to claim 5 further comprising a pontoon floating platform.

8. An apparatus according to claim 7, wherein said ejector is connected to a store of linear fibrous element located on the pontoon and wherein a protective sheath is provided to protect the linear fibrous element passing from the store to the ejector.

9. An apparatus according to claim 8, wherein said injection means is connected to a seabed pumping facility.

10. An apparatus according to claim 9, wherein said injection means comprises an annular chamber surrounding the ejector and provided with diametrical fins.

11. An apparatus according to claim 10, wherein a deflector is provided to direct the injected solid particles toward the fine fibrous trap.

12. An appartus according to claim 11, wherein said bell includes openings for the controlled discharge of gas contained therein.

* * * * *